United States Patent [19]

Newcomb et al.

[11] Patent Number: 4,930,776

[45] Date of Patent: Jun. 5, 1990

[54] GAME BALL

[76] Inventors: Nelson F. Newcomb, Windleblo Rd.; Nelson F. Newcomb, Jr., Windleblo Rd., both of Mirror Lake, N.H. 03853

[21] Appl. No.: 389,228

[22] Filed: Aug. 3, 1989

[51] Int. Cl.[5] ..... A63B 39/00; A63B 43/06

[52] U.S. Cl. ..... 273/58 B; 273/58 G; 273/DIG. 24; 273/DIG. 20; 446/219

[58] Field of Search ..... 273/58 R, 58 A, 58 B, 273/58 BA, 58 D, 58 G, 58 K, DIG. 24, DIG. 20, 65 EE, 65 EG, 65 EC, 65 ED; 446/219

[56] References Cited

U.S. PATENT DOCUMENTS

| | | | |
|---|---|---|---|
| 2,738,616 | 3/1956 | Windle | 446/219 |
| 4,002,893 | 1/1977 | Newcomb et al. | 273/58 G |
| 4,717,158 | 1/1988 | Pennisi | 273/DIG. 24 |

*Primary Examiner*—George J. Marlo
*Attorney, Agent, or Firm*—Ernest V. Linek

[57] ABSTRACT

The present invention takes the WIFFLE® BALL baseball into the darkness and allows for the continued play, without need of any complicated or expensive lighting equipment or the like. The standard WIFFLE® BALL baseball design is retained, and instead of traditional white plastic, a translucent plastic material is employed in the construction of the ball. Inserted into the ball for night play is an activated chemiluminescent light stick, such as those manufactured by, or under license from, the American Cyanamid Company and sold under the trademark CYALUME®. The light stick used herein is an elongated flexible tubular member, joined at its ends with a connecting piece forming a circular light-ring. The light ring is readily inserted into the cavity of the translucent WIFFLE® BALL baseball and retained therein without the need of any special attachments or further modifications. Under field testing, the thus modified NITELITE WIFFLE® BALL baseball performed like a traditional white plastic WIFFLE® BALL baseball, and the light-ring provided ample visible light for about 4–6 hours.

8 Claims, 1 Drawing Sheet

GAME BALL

BACKGROUND OF THE INVENTION

This invention relates to a ball and more particularly to that type of ball known commercially as a WIFFLE® BALL baseball, which has been modified to make it suitable for play after dark.

In the playing of games wherein a ball is stuck by a bat, or the like, a disadvantage has often been encountered in respect to the limitations of space in certain areas where the game is played. In addition, because of the construction of the ball itself, with which these games are played, injury to property and persons are sustainable. Further, such games are often times not able to be played by younger children or by persons, who, because of the limited space available or for other reasons, do not desire to run in participating in the game. It is therefore desirable to provide a ball of such construction as to be limited in its flight but still having features which would necessitate the use of skill in the use of an play with the same. The WIFFLE® BALL baseball accomplished these objective and more. However, upon approach of darkness, or in reduced light conditions, the WIFFLE® BALL baseball, like other conventional play balls, was of little use.

SUMMARY OF THE INVENTION

The present invention takes the WIFFLE® BALL baseball into the darkness and allows for the continued play, without need of any complicated or expensive lighting equipment or the like. The standard WIFFLE® BALL baseball design is retained, and instead of traditional white plastic, a translucent plastic material is employed in the construction of the ball. Inserted into the ball for night play is a ring-shaped, activated chemiluminescent light stick, such as those manufactured by, or under license from, the American Cyanamid Company and sold under the trademark CYALUME®.

In a preferred embodiment, the light stick is an elongated flexible tubular member, joined at its ends with a connecting piece forming a circular light-ring. The light ring is readily inserted into the cavity of the translucent WIFFLE® BALL baseball and retained therein without the need of any special attachments or further modifications. Under field testing, the thus modified NITE-LITE WIFFLE® BALL baseball performed like a traditional white plastic WIFFLE® BALL baseball, retaining its ability to curve during flight, and the light-ring provided ample visible light for about 4–6 hours.

BRIEF DESCRIPTION OF THE DRAWINGS

Other advantages of the present invention are set forth in greater detail in the accompanying specification as illustrated by the accompanying drawing in which.

DETAILED DESCRIPTION OF THE INVENTION

Figure 1:
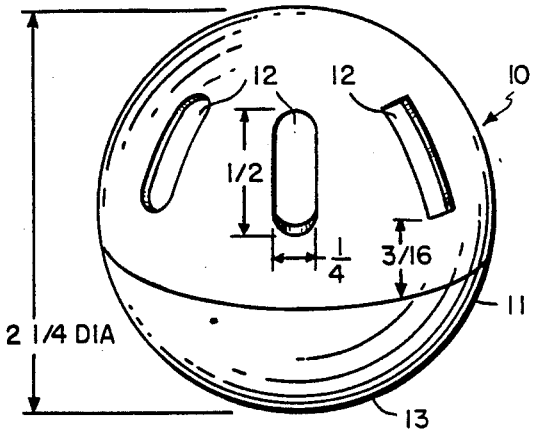
FIG. 1 is an isometric view of the game ball of the present invention.

In the drawings the game ball 10 comprise a hollow spherical shell 11 of substantially the same size as a standard baseball. While this size is disclosed for the purposes of this description, it will be understood that the ball may be of any suitable size, as for example, the size of a standard softball, or the like.

The shell 11 is made of a translucent plastic material, such as polyethylene or the like for reasons hereinafter set forth, and is molded into the desired shape. The shell 11 is provide with a series of apertures 12. According to the present invention, the apertures 12 do not extend over the entire surface of the ball but instead the ball has an imperforate portion 13. The apertures 12 themselves may be provided for in a number of ways, as for example, by simply cutting them out of the finished ball or within the molding process itself.

Figure 2:
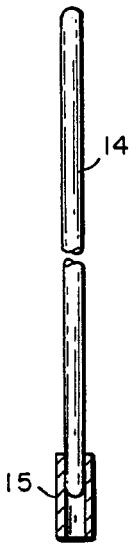
FIG. 2 is a sectional view of the light stick and ring connecting member therefor.

As illustrated in FIG. 2, a chemiluminescent light stick 14 is provided with a connecting member 15, e.g., a hollow rubber or plastic tube, which allows the ends of the light stick to be connected and formed into a light-ring.

Figure 3:
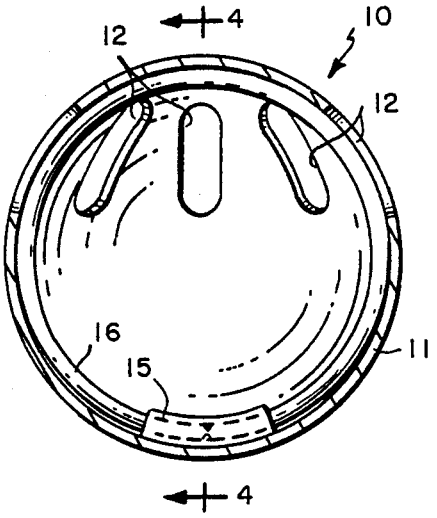
FIG. 3 is a cross-sectional view through the ball of the present invention, showing the light-ring in place.
Figure 4:
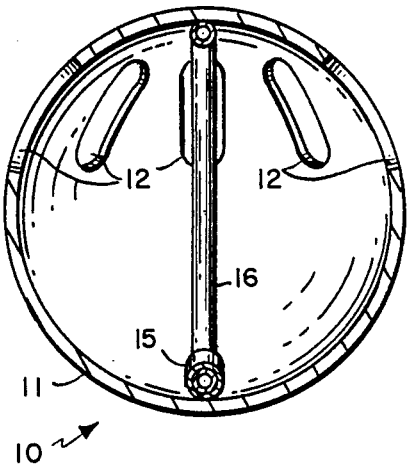
FIG. 4 is sectional view taken along line 4—4 of FIG. 3.

FIGS. 3 and 4 illustrate the light ring 16, disposed within the interior of the translucent plastic shell of the ball. As described above, the light ring is a chemiluminescent light stick having a ring, or generally circular shape. The size of the light-ring is selected so as to fit snugly within the interior space defined by the shell of the ball, i.e.. a softball size stick is larger than a baseball size stick. The stick used in the baseball size version is a flexible tubular plastic light stick (from American Cyanamid) about 18.5 cm×0.5 cm which can readily be bent into a ring and attached end-to-end with a small section of clear plastic tubing. Bending the light stick into the "ring" shape also activates the light stick by causing the mixing of the chemiluminescent materials retained therein. The activated light ring is then slipped into the cavity of the ball through one of the apertures 12.

Those who have played with a traditional WIFFLE® BALL baseball know that a ball having the apertures 12 and the imperforate portion 13 has surfaces of different air resistance and when thrown or struck, will follow a curved path when spinning in flight. Surprisingly, it has been discovered that when a conventional "stick-like" light stick is added to the ball, it disrupts the aerodynamics sufficiently to prevent this curved flight path. Lightsticks having lengths of 1.5", 2" and 3" were used, and the balls thus modified would not curve. However, when the light-ring shaped light stick of the present invention was used, the ability to curve in flight was maintained.

As modified, the WIFFLE® BALL baseball of the present invention will still exhibit a curved flight path which can be very unsteady, e.g., wherein the ball will curve to the right and left and upward and downward during the same flight. Thus, the curving path of the ball when in flight necessitates the exercise of skill to meet the same with means to strike it, as for example a bat or the like. In addition, skill will have to be exercised in catching or fielding the ball after it is struck, for the reasons that the differing air-resistant surfaces also cause the ball to curve after it has been struck.

Like the traditional white plastic WIFFLE® BALL baseball, the ball of the present invention will not travel for any relatively long distance despite the force with which it is struck and, in fact, cannot be thrown for any relatively long distance despite the force exerted. As a consequence, there is no necessity for the provision of a large playing area when using this ball and games may be devised with the use of the ball which eliminate the necessity of a great deal of running in connection therewith.

The features of the traditional white plastic WIFFLE® BALL baseball are likewise advantageous in night play using the NITELITE WIFFLE BALL baseball. A small play field aids in visibility of the illuminated ball. Lost balls become a thing of the past, since the NITELITE WIFFLE BALL has good night visibility in bushes, tall grass, etc.

Like the traditional white plastic WIFFLE® BALL baseball, the ball of the present invention is constructed of a hollow, lightweight, spherical shell and will not cause injury to persons using the same even if they are struck thereby. In addition the construction prohibits damage to property, such as windows or the like if struck in the area in which the ball is used.

The spherical molded shell 11, comprising the ball, is preferably provided of sufficient thickness so that it may be struck, or strike other objects with great impact without damage to the ball. The material preferably used in the construction of the ball is a translucent plastic, such as for example, polyethylene or the like and has structural strength inherent therein. In addition, the preferred location of the apertures in the surface of the ball as hereinafter set forth, eliminates weak spots.

While this construction has been described in great detail and results in the most preferable action of the ball with regard to maximum curvature aspects, maximum structural strength and maximum flight potential, it will be understood that other sized apertures may be used in different relationship to each other which would nevertheless provide a ball which will have the features desired as aforesaid.

The game ball of the present invention is advantageous in its preferred form and in all its modified forms, in that there is provided a non-injurious, non-damaging ball having structural strength and which will follow a path curving in many directions when spinning and in flight so that the exercise of skill is required in playing the game in which it is used.

While the invention has been described in some detail it will be understood that variations and modification may be made without departing from the spirit of the invention or the scope of the appended claims.

What is claimed is:

1. A game ball useful for night play, said game ball comprising:

a hollow, lightweight, translucent plastic spherical shell, said shell having a substantially imperforate portion, said shell further having a plurality of closely spaced perforations extending therethrough and providing a perforated zone characterized by surface openings, all said perforations and openings being grouped in one portion of said ball surface to cause the wind-resisting characteristics of the surface of said ball to vary unsymmetrically, whereby said ball when spinning in flight will follow a curved path, said shell further having disposed therein a ring-shaped, chemiluminescent light stick which, when activated, enables said ball to be sufficiently visible for play at night.

2. The game ball of claim 1, wherein said shell has an imperforate portion covering at least one-quarter of its surface.

3. The game ball of claim 1, wherein said shell has an imperforate portion covering at least one-half of its surface.

4. The game ball of claim 1, wherein said shell has an imperforate portion covering at least three-fourths of its surface.

5. The game ball of claim 1, Wherein said shell has a substantially imperforate portion covering at least one-quarter of its surface, the remainder of the shell having a plurality of closely spaced staggered perforations extending therethrough and providing a perforated zone characterized by surface openings.

6. The game ball of claim 5 in which the openings are quadrilateral.

7. The game ball of claim 1, wherein said shell has an imperforate portion covering at least one-half of its surface, the remainder of the shell having three rows of closely spaced perforations extending therethrough and providing a perforated zone characterized by surface openings.

8. A game ball comprising a hollow, lightweight translucent plastic spherical shell, approximately $2\frac{1}{4}$ inches in diameter, said shell having an imperforate portion covering at least one-half of its surface on one side of the equator of said shell, the remainder of the shell having closely-spaced rows of closely-spaced quadrilateral perforations extending therethrough and providing a perforated zone characterized by surface openings, all said perforations and openings being grouped in one portion of the ball surface to cause the wind-resisting characteristics of the surface of the ball to vary unsymmetrically, whereby the ball when spinning in flight will follow a curved path, the row of apertures next adjacent the equator being approximately 3/16 of an inch from said equator, and each of said apertures being approximately $\frac{1}{2}$ inch long and $\frac{1}{4}$ inch wide; said ball further including an activated chemiluminescent lightstick joined end to end into a ring shaped member.

* * * * *